US005287083A

United States Patent [19]

Person et al.

[11] Patent Number: 5,287,083

[45] Date of Patent: Feb. 15, 1994

[54] BULK METAL CHIP RESISTOR

[75] Inventors: Herman R. Person, Columbus, Nebr.; Felix Zandman, Philadelphia, Pa.

[73] Assignee: Dale Electronics, Inc., Columbus, Nebr.

[21] Appl. No.: 860,403

[22] Filed: Mar. 30, 1992

[51] Int. Cl.[5] ..... H01C 1/148; H01C 3/12

[52] U.S. Cl. ..... 338/332; 338/293; 338/325

[58] Field of Search ..... 338/332, 325, 293

[56] References Cited

U.S. PATENT DOCUMENTS

| | | | |
|---|---|---|---|
| 4,467,311 | 8/1984 | Person et al. | 338/293 |
| 4,467,311 | 8/1984 | Person et al. | 338/293 |
| 4,698,614 | 10/1987 | Welch et al. | 338/332 X |
| 4,706,060 | 11/1987 | May | 338/332 X |
| 5,160,912 | 11/1992 | Burke et al. | 338/332 X |
| 5,170,146 | 12/1992 | Gardner et al. | 338/332 X |
| 5,179,366 | 1/1993 | Wagner | 338/313 |

*Primary Examiner*—Marvin M. Lateef
*Attorney, Agent, or Firm*—Zarley, McKee, Thomte, Voorhees, & Sease

[57] ABSTRACT

A bulk metal chip resistor includes an elongated resistor element having terminals at its opposite ends. The terminals are formed by coating the opposite ends of the resistor element with a conductive material. Insulative material may be molded around the center portion of the resistor to provide structural support, and the ends of the resistor can be bent downwardly so as to cause the central portion to be raised when the resistor is mounted on a circuit board. A modified form of the invention includes wrapping the resistance element around the ends of a rectangular substrate so that the substrate provides structural support. Another modified form includes placing four terminals at the four corners of the resistor element.

19 Claims, 2 Drawing Sheets

BULK METAL CHIP RESISTOR

BACKGROUND OF THE INVENTION

The present invention relates to a bulk metal chip resistor, and particularly to a bulk metal chip resistor that can be surface mounted on a circuit board.

Bulk metal resistors have been known in the prior art, and an example of such a resistor is shown in U.S. Pat. No. 4,467,311. The resistor in that patent includes a flat metal plate having a plurality of slots extending inwardly from its lateral edges. A pair of electrical leads are welded or otherwise operatively secured to the opposite ends of the plate.

In prior art axial lead resistors such as shown in U.S. Pat. No. 4,467,311, the bulk metal resistance element or plate is generally formed from a material having a low temperature coefficient of resistance (TCR) often in the range of 25 ppm/° C. The axial leads welded to the resistor are usually formed of copper or other highly conductive metals having a very high TCR which is generally above 150 ppm/° C.

The axial leads of prior art resistors influence both the overall resistance value and the overall TCR of the resistor. The leads affect the overall TCR of the resistor in direct proportion to the ratio of the resistance value of the leads to the resistance value of the resistance element. In lower value resistors (for example 1 ohm or less) the resistance value of the long axial leads is high compared to the resistance value of the low value resistance element. As a result, in these lower value resistors, the leads significantly raise the overall TCR of the resistor above the lower TCR of the resistance element.

Another disadvantage of prior art axial lead resistors is in the manner in which heat is dissipated through the leads of the resistor to the board on which the resistor is mounted. The length of the leads retards the conduction of heat thereby causing the resistor to have a lower than desired wattage rating for any given size.

BRIEF DESCRIPTION OF THE INVENTION

Therefore, a primary object of the present invention is the provision of an improved bulk metal resistor.

A further object of the present invention is the provision of an improved bulk metal resistor which eliminates the need for axially extending terminals at the opposite ends thereof.

A further object of the present invention is the provision of an improved bulk metal resistor which utilizes terminals having a negligible effect upon the TCR of the completed resistor (with resistance element plus leads), and which cause the resulting entire resistor to have a TCR closely approximating the TCR of the resistance element.

A further object of the present invention is the provision of an improved bulk metal resistor which is made from one contiguous piece of resistance metal.

A further object of the present invention is the provision of an improved bulk metal resistor which reduces the cost of material in the resistor by eliminating the separate terminals.

A further object of the present invention is the provision of an improved bulk metal resistor which reduces the cost of labor in production by reducing the number of parts to be assembled.

A further object of the present invention is the provision of a bulk metal resistor which increases the heat dissipation capabilities of the resistor by having the resistance material itself closely adjacent the board on which it is mounted and in good heat conducting contact therewith so as to provide a very good heat sink.

A further object of the present invention is the provision of an improved bulk metal resistor wherein the size and design of the part will lend itself to being surface mounted on a mounting board.

A further object of the present invention is the provision of a bulk metal chip resistor which is easily solderable on a surface mount board.

A further object of the present invention is the provision of an improved bulk metal chip resistor which is simple to manufacture, efficient in use, and durable in construction.

SUMMARY OF THE INVENTION

The present invention utilizes a resistance element comprised of an elongated rectangular plate of resistance material. A preferred material for this purpose is a product manufactured by Carpenter Technology Corporation under the trademark "Evanohm". This product is designated "Evanohm Alloy R" and is comprised of 75% nickel, 20% chromium, 2.5% aluminum, and 2.5% copper. This material has a TCR of approximately 25° ppm/° C. The first step in the construction of the resistor is to coat the rectangular resistance element with a nickel undercoat and a tin-lead overcoat by placing the plate in a barrel plater so that the plating material covers the entire surface of the part. This process makes the plating operation more economical than in prior methods. The coating is then removed from the central portion of the rectangular plate so as to leave two plated terminal elements at the opposite ends of the resistance plate. One way to remove the plating from the center of the resistance element is to use a laser beam to cut grooves into the edges of the central portion of the resistance plate, so as to cause the resistance plate to have the desired resistance value. The laser will burn away the plating at the central portion of the resistor so as to prevent the plating on the two opposite ends from being in electrical contact with one another except through the "Evanohm" resistor element.

It is also possible to remove the plating by using a wire brush to brush the flat central surface of the resistance element so as to remove the conductive plating at the center of the resistance element. Also, the cutting of the grooves into the side edges of the resistance element can be accomplished by other means such as stamping, cutting with a diamond wheel, machining, or etching.

The central portion of the resistance element optionally can be coated with an insulative dielectric material which provides structure and support to the element, but it is not essential that such an insulative material be used unless the foil is too thin.

In the preferred form of the resistor, the ends of the resistance element are bent downwardly so as to cause the central portion of the resistance element to be supported above the board on which the device is mounted.

A modified form of the invention contemplates wrapping the ends of the plated resistance element around the ends of a substrate and crimping them in place so that the substrate will provide structural support for the resistance element. Then the conductive plating is removed from the center of the resistance element, and an insulative material is coated over the exposed center of the resistance element.

Another modified form of the invention contemplates using the flat resistance element with the metal coating terminals on the ends of the resistance element, but without bending the resistance element as in the above described preferred embodiment. Instead, the resistance element remains in a single plane. This is the most simple form of Applicants' invention.

A further modified form of the invention contemplates placing separate terminals at each of the four corners of the resistance element, with each of the four terminals being separate from one another. This permits the use of a four lead bulk chip resistor.

DETAILED DESCRIPTION OF PREFERRED EMBODIMENT

Figure 2:
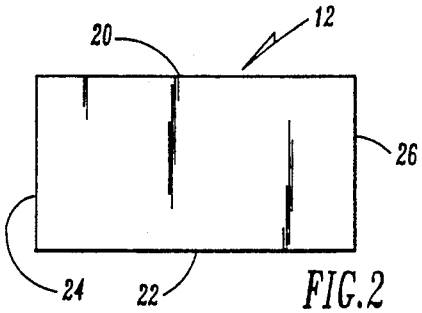
FIG. 2 is a top plan view of the resistance element used in the first step of the manufacturing process.

Referring to the drawings, the numeral 10 generally designates a bulk metal chip resistor which is the preferred embodiment of the present invention. Resistor 10 includes a resistance body 12 (FIG. 2) which is rectangular in shape and which includes opposite side edges 20, 22, a first end 24, and a second end 26. On the ends of resistor 10 are a pair of conductive terminals 14, 16 which comprise a coating of electrically conductive material which has been coated over the ends 24, 26 of resistance body 12. An insulative material 18 is molded around the center portion of the resistance body 12.

The steps in the construction of resistor 10 are shown in FIGS. 2-10. Initially the resistance body 12 is formed into the rectangular shape shown in FIG. 2. The resistance body 12 is manufactured from a resistance material such as the "Evanohm Alloy R" material described above. This resistance material usually has a thickness of from 1 mill to 7 or 8 mills, depending upon the resulting resistance which is desired for the completed resistor. If the material is 3 mills or greater, it generally has sufficient rigidity to be self-supporting, but a resistance material less than 3 mills may require additional support from a substrate as shown in later embodiments below. For example, a resistor manufactured by this process could be formed into a resistance element 3 mills thick and having dimensions of 0.250 inches by 0.100 inches. Slots can be cut in the sides of such a resistance element to increase its original resistance value of approximately 0.04 ohms to a resulting resistance of as high as 2.6 ohms. Lower values could be obtained by using thicker resistance material. The preferred thickness would be approximately 6 mills because this would provide more than adequate strength and still produce a resistance range of from 0.02 ohms to 1.4 ohms in the 0.250 inch by 0.100 inch size. Different chip resistor sizes would have different value ranges.

Figure 3:
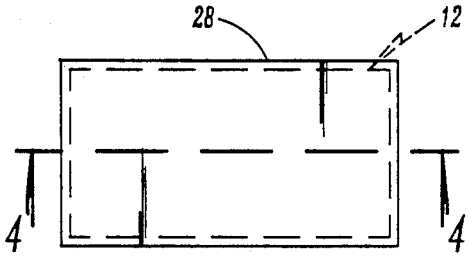
FIG. 3 is a plan view of the resistance element of FIG. 2 after a coating of conductive material has been placed thereon.
Figure 4:
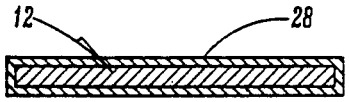
FIG. 4 is a sectional view taken along line 4—4 of FIG. 3.

The second step in the manufacture of the resistor is the coating of the resistance element 12 with a conductive coating 28 (FIGS. 3 and 4). This conductive coating preferably is a two-coat process utilizing a nickel undercoat and a tin-lead overcoat. The plating covers the entire surface of the part and is accomplished by placing the resistance elements 12 in a barrel plater. This makes the plating operation very economical and simple. The thickness of the resulting coating 28 is substantially less than the thickness of the resistance element 12, resembling a coat of conductive paint.

Figure 1:
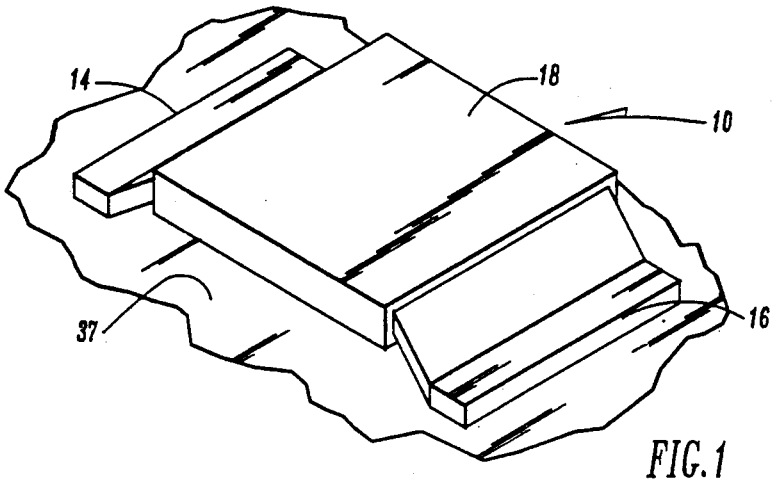
FIG. 1 is perspective view of the preferred embodiment of the present invention.
Figure 5:
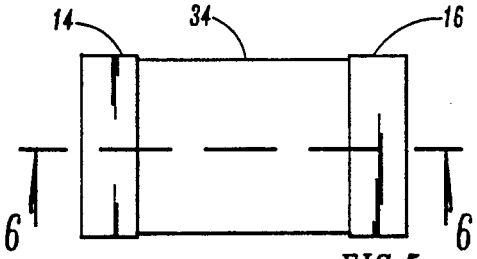
FIG. 5 is a plan view of the resistance element shown in FIG. 3, but showing the central portion of the conductive coating removed to expose the original resistor element.
Figure 6:
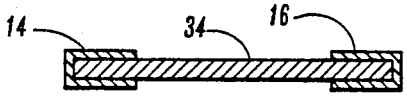
FIG. 6 is a sectional view taken along line 6—6 of FIG. 5.
Figure 7:
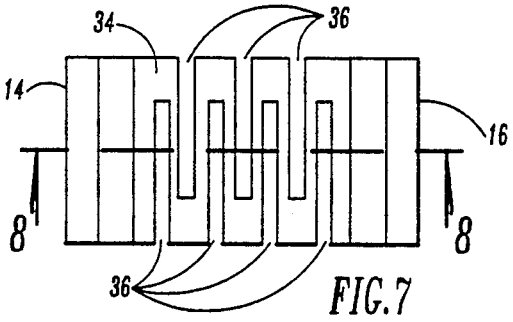
FIG. 7 is a top plan view of the resistance element after the grooves have been cut in the resistance element and after the ends of the resistance element have been bent downwardly.
Figure 8:
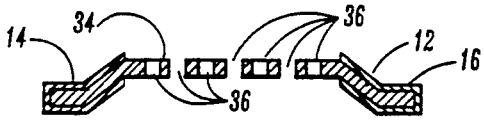
FIG. 8 is a sectional view taken along line 8—8 of FIG. 7.

FIGS. 5 and 6 show the next step in the manufacturing process. The coating material 28 is removed from the exposed central portion 34 of the resistor, leaving two terminals 14, 16 at the opposite ends of the resistance element. The exposed portion 34 may be produced by wire brushing the resistance element, or it can also be produced by using laser beams to cut grooves or slots into the edges of the resistance element 12. This cutting step is shown in FIGS. 7 and 8. A plurality of grooves or slots 36 are alternatively cut into the opposite edges of the central portion 34 of the resistance element 12 so as to increase the resistance of the resistance element 12 to the desired value. Also, the ends of the resistance element 12 are bent downwardly as can be seen in FIG. 8 so as to enable the terminals 14, 16 to engage and directly contact the contact pads on a circuit board such as circuit board 37 shown in FIG. 1. The slots 36 are cut in the central portion 34 of the resistor so as to achieve the desired resistance value. These slots 36 can be cut by laser beems, or they can be cut by stamping, cutting with a diamond wheel, machining, or etching.

Figure 9:
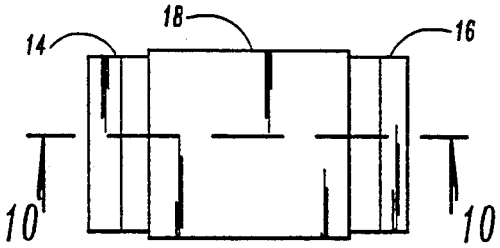
FIG. 9 top plan view of the resistor after the insulative coating has been placed thereon.
Figure 10:
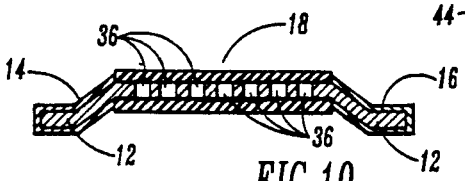
FIG. 10 is a sectional view taken along line 10—10 of FIG. 9.

The final step of construction involves the molding of a dielectric insulation material 18 around the central portion 34 of the resistor as shown in FIGS. 9 and 10 so as to protect the resistance element 12 from the outside elements.

Several unique advantages are obtained by the bulk metal chip resistor 10 described above. Since the resistor is made from one contiguous piece of metal, and since the terminals 14, 16 comprise plated conductive material coated over the ends of the resistance element 12, the heat generated by $I^2R$ losses is quickly conducted from the center of the resistor to the terminals where it is dissipated to the Printed Circuit Board 37. This allows the part to have a higher wattage rating for its size than would be obtainable with an axial lead resistor such as shown in U.S. Pat. No. 4,467,311.

The terminals 14, 16 are short and wide which allows this design to be used for surface mounting. The coating of the part with insulative material 18 helps maintain its mechanical integrity and the terminals 14, 16 are slightly bent to make certain that the part will solder easily to a flat PC Board.

The TCR of the resistance element 20 is approximately 25 ppm/° C., whereas the TCR of the conductive plating material 28 is substantially higher, on the order of 1500° to 2000 ppm/° C. However, because the terminals 14, 16 are very thinly coated with the conductive material 28, the distance through which the current must pass comprises only the thickness of the coating material 14, 16, and is relatively small compared to the overall length of the resistance element 20. As a result of these dimensions, the resulting TCR of the entire resistor 10 is very close to the TCR of the resistance material 20. That is, the electrical conductive material of terminals 14, 16 has a negligible effect upon the overall resulting TCR of the resistor. This makes it possible to make a low value resistor (for example 1 ohm or less) having a much lower TCR than comparably sized resistors manufactured with axially extending leads such as shown in U.S. Pat. No. 4,467,311.

Figure 11:
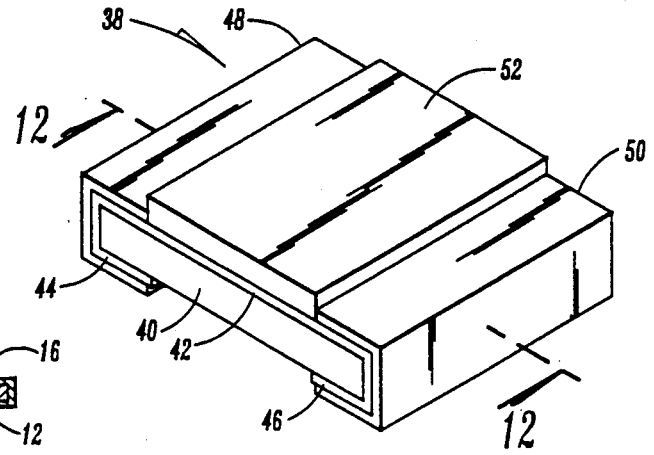
FIG. 11 is a perspective view of a modified form of the present invention.
Figure 12:
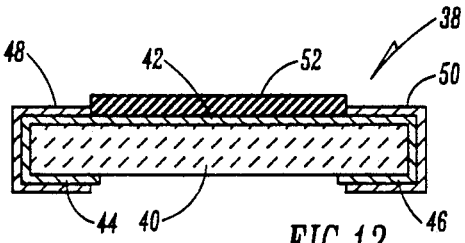
FIG. 12 is a sectional view taken along line 12—12 of FIG. 11.

Referring to FIGS. 11 and 12, a modified form 38 of the resistor is shown. Resistor 38 utilizes a substrate 40 of alumina or other ceramic or plastic material. A rectangular resistor element 42 includes U-shaped ends 44, 46 which are wrapped around and crimped over the ends of the substrate 40 so as to attach the resistance element 42 to the substrate 40. The conductive leads 48, 50 are plated conductive material coated onto resistance element 42 in the manner described previously for the device shown in FIGS. 1–10. Resistance element 42 can be solid as shown in the drawings, or can be cut with slots to achieve the desired resistance value in the same manner as described for the embodiment of FIGS. 1–10. An insulative material 52 is coated over the central portion of resistance element 42 so as to protect it from the elements.

Figure 13:
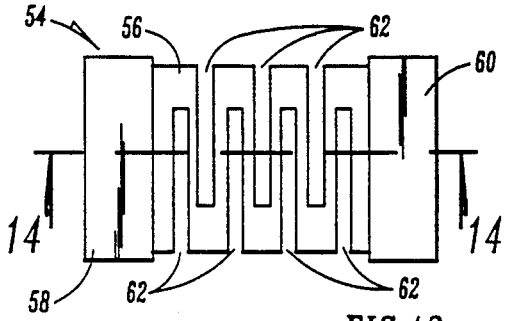
FIG. 13 is a top plan view of a modified form of the present invention.
Figure 14:
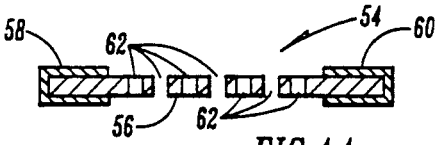
FIG. 14 is a sectional view taken along line 14—14 of FIG. 13.

Referring to FIGS. 13 and 14, the simplest form of Applicants' invention is shown and is designated by the numeral 54. Resistor 54 is similar in construction to the resistor shown in FIGS. 1–10, with the exception that it does not include an insulative protective cover over the central portion of the resistor, and the ends of the resistor are not bent downwardly as is the case with resistor 10 shown in FIGS. 1–10. Resistor 54 includes a rectangular resistor element 56 having conductive terminals 58, 60 formed at the opposite ends thereof. Slots 62 are cut into the edges of resistance element 56 so as to achieve the desired resistance value for the resistor 54.

Figure 15:
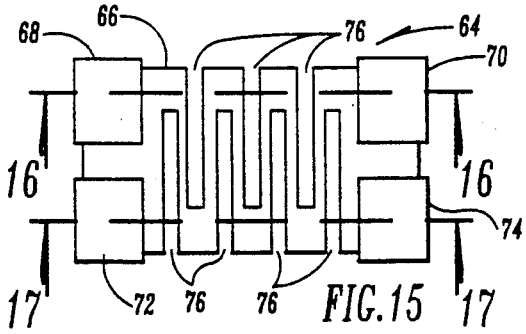
FIG. 15 is a top plan view of a modified form of the present invention.
Figure 17:
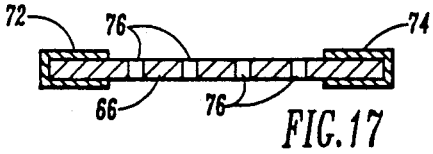
FIG. 17 is a sectional view taken along line 17—17 of FIG. 15.
Figure 16:
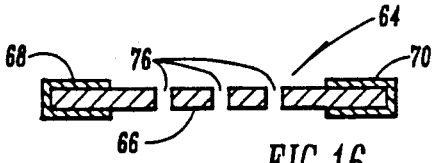
FIG. 16 is a sectional view taken along line 16—16 of FIG. 15.

The resistor of the present invention can also be constructed to have four terminals rather than two. Such a modified form of Applicants' invention is shown in FIGS. 15–17 and is designated by the numeral 64. Resistor 64 includes a resistance element 66 similar to that shown in the prior resistors of FIGS. 1–14. Grooves or slots 76 are cut in the edges of resistance element 66. The four corners of the resistance element 66 are provided with a first terminal 68, a second terminal 70, a third terminal 72, and a fourth terminal 74. These terminals are formed of conductive material in the same manner as the resistors shown in FIGS. 1–14. However, the terminals 68, 70, 72, 74 are separated from one another by brushing away or otherwise removing the conductive plating material therebetween so that each of the four terminals is free from electrical connection with one another. An alternative construction (not shown) could be made by using a laser to cut an axially extending slot in the appropriate ends of resistance element 66 for the purpose of separating terminals 68, 72 and terminals 70, 74. An example of a use of a four terminal resistor would be to utilize terminals 68, 70 as current leads connected to a source of current, and to utilize terminals 72, 74 as voltage leads for measuring voltage across the resistor.

All of the foregoing modified forms of the invention make possible the production of a completed low value resistor which has a TCR closely approximating the temperature coefficient of the resistor element. The terminals at the ends of the resistors have a negligible effect on the overall TCR of the resulting resistor. While the terminals are described as having been made by the preferred method of tumbling in a barrel plater, other methods of coating could be utilized such as printing or other methods. Thus, it can be seen that the device accomplishes at least all of its stated objectives.

We claim:

1. A resistor comprising:

an elongated resistor body having first and second opposite ends and a central portion therebetween, said resistor body being of unitary construction and being comprised of a resistance material shaped to produce a predetermined resistance value between said first and second opposite ends;

first and second terminals in electrical contact with said first and second ends respectively of said resistor body, said first and second terminals being formed of an electrically conductive material having an electrical conductivity higher than said resistance material of said resistance body, said first and second terminals being free from electrical contact with one another so that said resistor body forms the only electrical connection between said first and second terminals;

said first and second terminals each comprising a coating of said electrically conductive material on said first and second opposite ends of said resistor body;

said resistor element being formed of a material having sufficient thickness to be self supporting without the aid of a substrate.

2. A resistor according to claim 1 wherein the temperature coefficient or resistance of said resistance material of said resistor body is substantially less than the TCR of said conductive material of said first and second terminals, the terminals have lower ohms per square than the resistor body, and the combined TCR resistor body and said first and second terminals closely proximates said TCR of said resistor body.

3. A resistor according to claim 1 wherein said first and second opposite ends of said resistors body are bent with respect to said central portion so that said first and second terminals, when resting on a horizontal support surface, will cause said central portion to be supported in spaced relation above said supporting surface.

4. A resistor according to claim 1 and further comprising a dielectric substrate, said resistor body being supported on and operatively attached to said substrate whereby said substrate provides structural support to said resistor body.

5. A resistor according to claim 4 wherein said resistor body comprises a rectangular plate and said substrate is in a rectangular shape having a top surface, a bottom surface and opposite ends, said central portion of said resistor body being supported on said top surface of said substrate and said first and second ends of said resistor body wrapping around said opposite ends of said substrate and engaging said bottom surface of said substrate.

6. A resistor according to claim 1 wherein said central portion of said resistor body is rectangular in shape, having a top rectangular surface, a bottom rectangular surface, and opposite rectangular side edges extending between said first and second opposite ends of said resistor body, at least one cut being made completely through said central portion from said top rectangular surface to said bottom rectangular surface, said one cut extending inwardly from one of said side edges of said central portion.

7. A resistor according to claim 6 wherein said cut is formed by using a laser to cut through said central portion of said resistor body.

8. A resistor according to claim 6 wherein said cut is formed by one of the methods selected from the group consisting essentially of stamping, cutting with a diamond wheel, machining, and etching.

9. A resistor according to claim 1 wherein said layers of electrically conductive material are placed on said first and second ends of said resistor body by plating.

10. A resistor according to claim 1 and further comprising third and fourth terminals in electrical contact with said first and second ends of said resistor body, said first, second, third, and fourth terminals being free from electrical contact with one another so that said resistor body forms the only electrical connection therebetween, said third and fourth terminals each comprising a layer of said electrically conductive material on said first and second opposite ends of said resistor body.

11. A resistor according to claim 10 said resistor body is rectangular in shape and includes four corners, said first, second, third, and fourth terminals each being located adjacent one of said four corners.

12. A resistor according to claim 1 wherein said resistor element has a thickness greater than three mils.

13. A resistor comprising:

an elongated resistor body having first and second opposite ends and a central portion therebetween, said resistor body being of unitary construction and being comprised of a resistance material shaped to produce a predetermined resistance value between said first and second opposite ends;

first and second terminals in electric contact with said first and second ends respectively of said resistor body, said first and second terminals being formed of an electrically conductive material having an electrical conductivity higher than said resistance material of said resistance body, said first and second terminals being free from electrical connection between said first and second terminals;

said first and second terminals each comprising a coating of said electrically conductive material on said first and second opposite ends of said resistor body;

the temperature coefficient of resistors (TCR) of said resistance material of said resistor body being substantially less than the TCR of said conductive material of said first and second terminals, said first and second terminals having lower ohms per square than said resistor body, and the combined TCR of said resistor body and said first and second terminals closely approximating said TCR of said resistor body.

14. A resistor comprising:

an elongated resistor body having first and second opposite ends and a central portion therebetween, said resistor body being of unitary construction and being comprised of a resistance material shaped to produce a predetermined resistance value between said first and second opposite ends;

first and second terminals in electric contact with said first and second ends respectively of said resistor body, said first and second terminals being formed of an electrically conductive material having an electrical conductivity higher than said resistance material of said resistance body, said first and second terminals being free from electrical connection between said first and second terminals;

said first and second terminals each comprising a coating of said electrically conductive material on said first and second opposite ends of said resistor body;

said first and second opposite ends of said resistor body being bent with respect to said central portion so that said first and second terminals, when resting on a horizontal support surface, will cause said central position to be supported in spaced relation above said supporting surface.

15. A resistor comprising:

an elongated resistor body having first and second opposite ends and a central portion therebetween, said resistor body being of unitary construction and being comprised of a resistance material shaped to produce a predetermined resistance value between said first and second opposite ends;

first and second terminals in electric contact with said first and second ends respectively of said resistor body, said first and second terminals being formed of an electrically conductive material having an electrical conductivity higher than said resistance material of said resistance body, said first and second terminals being free from electrical connection between said first and second terminals;

said first and second terminals each comprising a coating of said electrically conductive material on said first and second opposite ends of said resistor body;

a rectangularly shaped dielectric substrate having a top surface a bottom surface, and opposite ends;

said resistor body being supported on and operatively attached to said substrate whereby said substrate provides structural support to said resistor body;

said resistor body being in the shape of a rectangular plate, said central portion of said resistor body being supported on said top surface of said substrate and said first and second ends of said resistor body wrapping around said opposite ends of said substrate and engaging said bottom surface of said substrate.

16. A resistor comprising:

an elongated resistor body having first and second opposite ends and a central portion therebetween, said resistor body being of unitary construction and being comprised of a resistance material shaped to produce a predetermined resistance value between said first and second opposite ends;

first and second terminals in electric contact with said first and second ends respectively of said resistor body, said first and second terminals being formed of an electrically conductive material having an electrical conductivity higher than said resistance material of said resistance body, said first and second terminals being free from electrical connection between said first and second terminals;

said first and second terminals each comprising a coating of said electrically conductive material on said first and second opposite ends of said resistor body;

said resistor body having an upper surface and a lower surface spaced apart a first thickness therebetween, said layers of said conductive material forming said first and second terminals having a layer thickness substantially less than said first thickness.

17. A resistor according to claim 16 wherein said first thickness is less than 0.010 inches.

18. A resistor comprising:

an elongated resistor body having first and second opposite ends and a central portion therebetween, said resistor body being of unitary construction and being comprised of a resistance material shaped to produce a predetermined resistance value between said first and second opposite ends;

first and second terminals in electric contact with said first and second ends respectively of said resistor body, said first and second terminals being formed of an electrically conductive material having an electrical conductivity higher than said resistance material of said resistance body, said first and second terminals being free from electrical connection between said first and second terminals;

said first and second terminals each comprising a coating of said electrically conductive material on said first and second opposite ends of said resistor body;

said central portion of said resistor body being rectangular in shape having a top rectangular surface, a bottom rectangular surface, and opposite rectangular side edges extending between said first and second opposite ends of said resistor body;

at least one cut being made completely through said central portion from said top rectangular surface to said bottom rectangular surface, said one cut extending inwardly from one of said side edges of said central portion.

19. A resistor comprising:

an elongated resistor body having first and second opposite ends and a central portion therebetween, said resistor body being of unitary construction and being comprised of a resistance material shaped to produce a predetermined resistance value between said first and second opposite ends;

first and second terminals in electric contact with said first and second ends respectively of said resistor body, said first and second terminals being formed of an electrically conductive material having an electrical conductivity higher than said resistance material of said resistance body, said first and second terminals being free from electrical connection between said first and second terminals;

said first and second terminals each comprising a coating of said electrically conductive material on said first and second opposite ends of said resistor body;

a third terminal and a fourth terminal in electrical contact with said first and second ends, respectively, of said resistor body;

said first, second, third, and fourth terminals being free from electrical contact with one another so that said resistor body forms the only electrical connection therebetween;

said third and fourth terminals each comprising a layer of said electrically conductive material supported by and in electrical contact with said first and second opposite ends of said resistor body.

* * * * *